US010004287B2

(12) United States Patent
Tziavragos

(10) Patent No.: US 10,004,287 B2
(45) Date of Patent: Jun. 26, 2018

(54) FASHION ACCESSORY FOR ATTACHMENT TO PANTS TO PREVENT HOLES IN SHIRTS

(71) Applicant: Paula Marie Tziavragos, New York, NY (US)

(72) Inventor: Paula Marie Tziavragos, New York, NY (US)

(73) Assignee: Ulterior Couture, LLC

( * ) Notice: Subject to any disclaimer, the term of this patent is extended or adjusted under 35 U.S.C. 154(b) by 22 days.

(21) Appl. No.: 15/351,834

(22) Filed: Nov. 15, 2016

(65) Prior Publication Data

US 2018/0077983 A1 Mar. 22, 2018

Related U.S. Application Data

(60) Provisional application No. 62/397,373, filed on Sep. 21, 2016.

(51) Int. Cl.
*A41D 27/12* (2006.01)
*A41D 1/06* (2006.01)
*A41D 27/08* (2006.01)

(52) U.S. Cl.
CPC ..... *A41D 27/12* (2013.01); *A41D 1/06* (2013.01); *A41D 27/08* (2013.01)

(58) Field of Classification Search
CPC ..... A41D 27/12; A41D 1/06; A41D 27/08
USPC ..... 2/46, 227, 228, 238, 236
See application file for complete search history.

(56) References Cited

U.S. PATENT DOCUMENTS 4,987,610 A * 1/1991 Hunt ..... A41D 13/0015 2/115
5,991,928 A * 11/1999 Smith ..... D06F 95/008 2/300
6,820,281 B2 * 11/2004 Mariland ..... A41D 27/20 2/115
7,263,446 B2 * 8/2007 Morin ..... G01N 29/11 702/33
8,429,762 B2 * 4/2013 Weisman ..... A41D 7/00 2/237
2016/0029714 A1 * 2/2016 Linden ..... A41D 13/055 2/236

* cited by examiner

*Primary Examiner* — Gloria Hale
(74) *Attorney, Agent, or Firm* — Daniel Kirshner

(57) ABSTRACT

A fashion accessory for protecting tee shirts from abrasion from buttons and/or seams of jeans formed from a front piece of fabric and a rear piece of fabric that are aligned and attached to each other. The fabric pieces are sewn together along their bottom edges, and along their side edges, but not as far as the top edge. A flap of fabric is formed in the front facing fabric. A buttonhole is formed into the flap. Snaps are positioned onto the flap and onto the rear piece of fabric. To employ, the device is tucked into the waistband of the pants up to the flap. The flap is folded down and the button of the jeans is inserted into the buttonhole of the flap. The top portion of the rear fabric is folded down over the flap. The snaps are snapped together securing the device.

4 Claims, 3 Drawing Sheets

FASHION ACCESSORY FOR ATTACHMENT TO PANTS TO PREVENT HOLES IN SHIRTS

CROSS REFERENCE TO RELATED APPLICATION

The present application claims priority to the earlier filed provisional application having Ser. No. 62/397,373 and a filing date of Sep. 21, 2016, and hereby incorporates the subject matter of the provisional application in its entirety.

FIELD OF THE INVENTION

The present invention is a fashion accessory for attachment to pants to prevent holes from forming in tee shirts or other fashion blouses. More specifically, the present invention for attachment to pants includes pieces of fabric attached together, a buttonhole for securing to a button of the pants, and coordinating snaps or other fasteners for closure.

BACKGROUND OF THE INVENTION

A nagging problem for wearers of jeans (or other pants) and tee shirts, fashion blouses or the like, is that holes form in the shirts which holes are caused by abrasion on the pants. Typically jeans have a button closure at the waist. Moreover, the seam at the waist can be harshly abrasive. Either the button closure for the jeans or the abrasive seam at the waist has a tendency to cause abrasions, tears, or holes into blouses or shirts worn with them. This is a nagging irritation as fashion tops can be expensive. Moreover, tears or holes formed into such fashion tops are unsightly, and can cause embarrassment to the wearer. These holes, tears or abrasions can show up on the tee shirts as early as the first wearing.

This is a known problem for wearers of fashion tops, but a problem without a known practical solution. The only solution heretofore has been to replace the damaged fashion tops with new ones or to sew or mend the damaged shirts. These solutions provide only a temporary fix, and it is expensive to constantly replace damaged shirts.

Therefore, it is the objective of the present invention to provide a fashion accessory. The fashion accessory of the present invention also functions to prevent damage to fashionable tee shirts, or other such tops, which damage is typically caused by abrasion with jeans or pants. The fashion accessory of the present invention can be provided in different colors or with various designs, logos, advertising material and/or trademarks to better coordinate with the outfit being worn. The present invention is easy to wear, easy to remove, and can be washed.

Other objects, advantages and novel features, and further scope of applicability of the present invention will be set forth in the detailed description to follow, taken in conjunction with the accompanying drawings, and in part will become apparent to those skilled in the art, upon examination of the following, or may be learned by practice of the invention. The objects and advantages of the invention may be realized and attained by means of instrumentalities and combinations particularly pointed out in the appended claim or claims.

SUMMARY OF THE INVENTION

The present invention is a fashion accessory for protecting tee shirts from abrasion from the buttons and/or seams of jeans. The present invention device is formed from a front piece of fabric and a rear piece of fabric that are aligned with each other and attached to each other. The fabric pieces are sewn together along their bottom edges, and along their side edges, but not as far as the top edge. As such, a flap of fabric is formed in the front facing fabric. A buttonhole is formed into the flap. Snaps or other closure means are positioned onto the flap and onto the rear piece of fabric. To employ the present invention, the device is tucked into the waistband of the pants up to the flap. The flap is now folded down and the button of the jeans is inserted into the buttonhole of the flap. Now, the top portion of the rear fabric is folded down over the flap. Finally, the snaps are snapped together, thereby securing the protective device of the present invention to the jeans and protecting the tee shirt from abrasion.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

The present invention is a fashion accessory in the nature of a device for attachment to pants that prevents holes from forming in shirts. More specifically, the present invention is formed from fabric and folds over the waist of pants at the pant's closure thereby protecting shirts from abrading on the pants. The present invention includes means for being securely attached to the pants.

Figure 1:
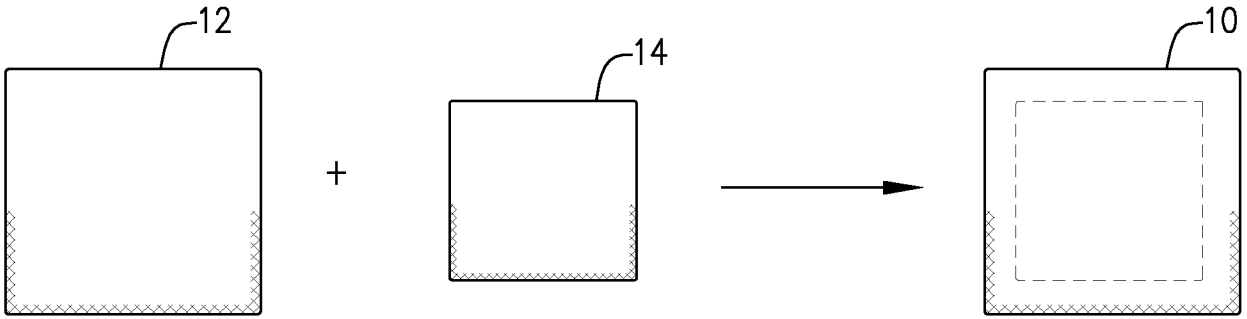
FIG. 1 is a front view of the back fabric of the present invention and showing the two component fabrics of which it is comprised.
Figure 2:
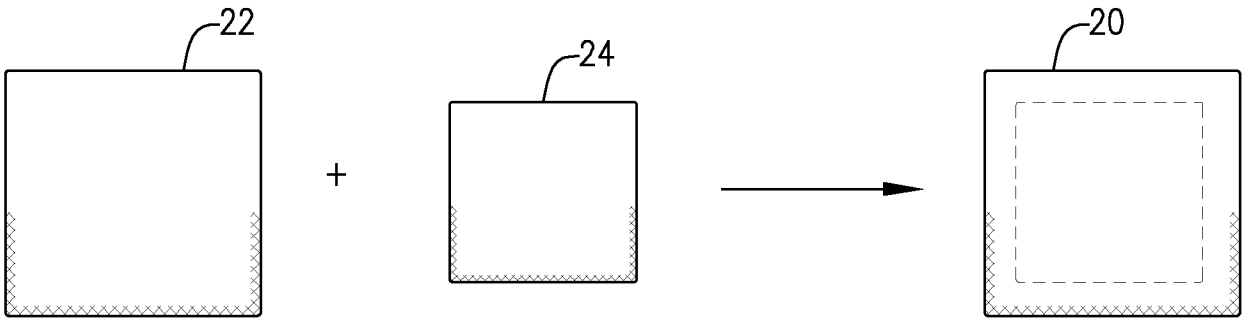
FIG. 2 is a front view of the front fabric of the present invention and showing the two component fabrics of which it is comprised.

Looking at the figures, and first at FIGS. 1 and 2, the present invention comprises pieces of fabric sewn or otherwise attached to each other. The fabric may be cotton, silk, leather, velvet, vinyl, suede, fur or any other fabric. In the embodiment shown in the figures, the back piece of fabric 10 is square and has approximate dimensions of 6" by 6". The front piece of fabric 20 is also square and also has approximate dimensions of 6" by 6". (It will be understood that all of the recited dimensions are not critical to the functionality of the invention, and that similar devices of differing dimensions are within the scope of the disclosure of this invention.) In the embodiment shown in the figures, it is noted that each of the fabric pieces 10 and 20 are comprised of two fabric pieces each, 12 and 14, and 22 and 24, respectively, where fabric pieces 14 and 24 are square with 5" sides. Either embodiment (four pieces of fabric or two pieces of fabric) is within the scope of this disclosure. A four-piece embodiment is preferred, as the exterior fabric can be fashion coordinated, but four pieces are not required for the functionality of the invention. For clarity, when employing four pieces of fabric, the interior fabric piece when the device is folded is a lining, and the exterior fabric piece may be fashionable colored and may contain a design, logo, pictures, embroidery, trademark, or other fashion indicia. Interfacing fabric may also be used. The exposed fabric and design must be smooth, and without any parts that may cause friction or abrasion to the tee shirt. In the preferred embodiment shown, the interior fabric pieces 14 and 24, are each square with approximate dimensions of 5" by 5". The interior pieces are sewn to the exterior pieces as shown in FIGS. 1 and 2 to form two square pieces each of which is 6" by 6", with a ½" border surrounding interior fabrics 14 and 24.

Figure 3:
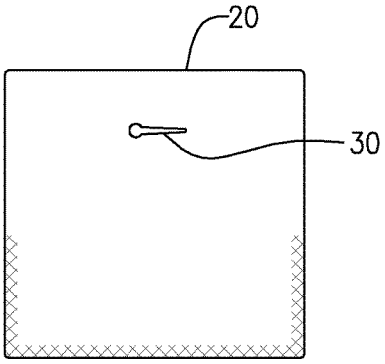
FIG. 3 is a front view of the front fabric of the present invention and showing the buttonhole.

Looking at FIG. 3, a buttonhole 30 is sewn into the front fabric piece 20, which buttonhole is situated approximately 1" from the top edge of fabric 20. The particular dimensions of the buttonhole are not critical, so long as it is appropriately sized for the button on the jeans, however, as shown in the figures, the buttonhole has a length of approximately ¾". The start of the buttonhole is located 2.5" from the left edge of fabric 20. The buttonhole is sewn around its perimeter for reinforcement.

Figure 4:
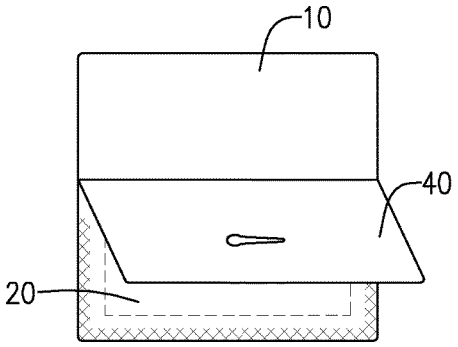
FIG. 4 is a front view of the present invention, showing the front and rear fabrics attached to each other and showing the flap.

Back fabric 10 and front fabric 20 are sewn or otherwise attached to each other. As seen best in FIG. 4, front fabric piece 20 is positioned in front of back fabric piece 10 with their bottom and side edges aligned. Now the bottom edges are attached together. Further, the side edges are attached together, but not all the way to the top edge; only approximately the bottom 2" of the side edges are attached together. As such, the top portion of front fabric 20 remains unattached to back fabric 10, thereby forming a flap of fabric denoted 40. Therefore, the buttonhole on the fabric 20 is positioned on the top middle of the flap as seen clearly in FIG. 4.

Figure 5:
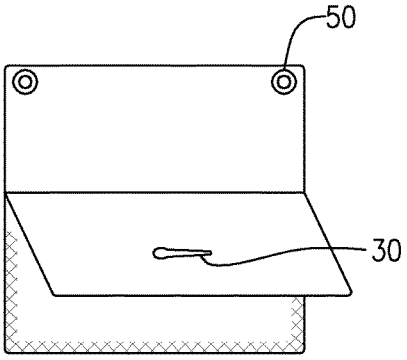
FIG. 5 is a front view of the present invention and showing the snaps on the rear fabric.
Figure 6:
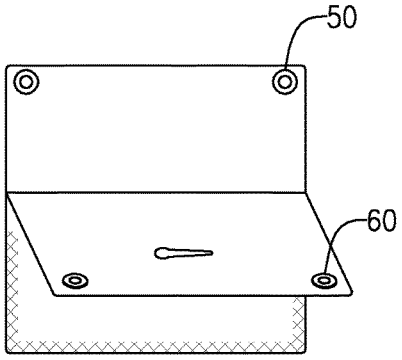
FIG. 6 is a front view of the present invention and showing the snaps on the front and rear fabrics.

Now looking at FIGS. 5 and 6, snaps 50 are affixed to the interior of back fabric piece 10, and coordinating snaps 60 are affixed to the interior of the flap 40. It will be understood that the snaps 50 and 60 are corresponding male and female snap members that attach to each other, and must be lined up with each other so that they can snap together when the present invention is in use. Other closures systems such as buttons/buttonholes or hook and loop closures will be within the scope of this disclosure.

Figure 7:
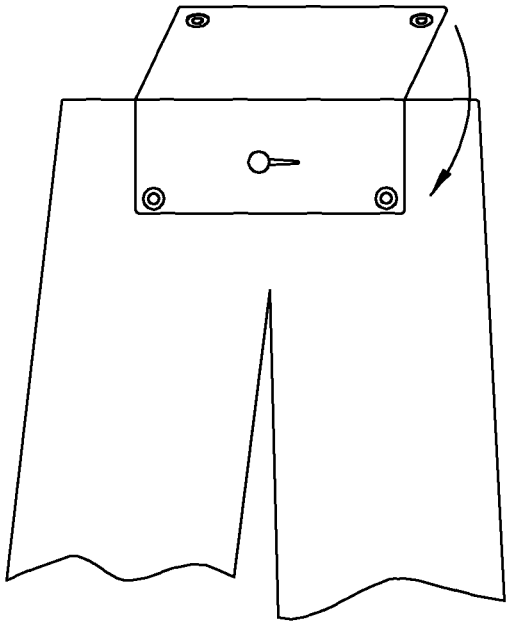
FIG. 7 is a front view of the present invention as it is being placed into the waistband of a user's pants.
Figure 8:
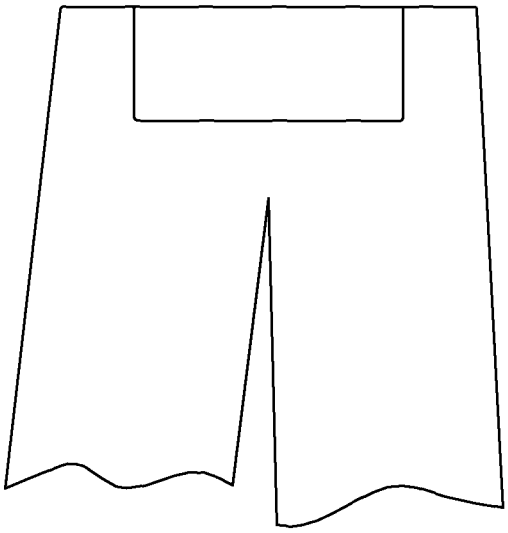
FIG. 8 is a front view of the present invention and showing it in use on a user's pants.

As seen best in FIGS. 7 and 8, the fashion accessory of the present invention is utilized as follows. When a user is wearing jeans, or other such trousers having an abrasive button or seam, and a shirt that is susceptible to tears or holes, the present invention is worn at the waist. First the user tucks the bottom half of the device into the waistband of the jeans up to the location of the flap so that the flap 40 drapes over the jeans at the front of the waist, as seen in FIG. 7. The flap is then folded down over the waistband and the button of the jeans is attached to the buttonhole 30 on the flap. Now, the top portion of the back fabric 10 is folded down over the flap. Finally, the snaps 50 and 60 are snapped together, thereby securing the protective device of the present invention to the jeans.

When the protective device of the present invention is secured into place on the waistband of the jeans, the tee shirt or fashion blouse will not abrade against the button of the jeans or its seams. As such, the blouse will be protected against tears and holes. In similar fashion to what has been described, the present fashion accessory can be utilized when the wearer is wearing a belt, thereby protecting the blouse from abrasion from the belt buckle. If the user is wearing a belt, the buttonhole is first buttoned to the jeans button. Next the belt is placed around the waist and over the flap. Now, the rear fabric is folded over the belt and the snaps secured as before.

The foregoing is considered as illustrative only of the principles and preferred embodiment of the invention. Furthermore, since numerous changes and modifications will readily occur to one skilled in the art, it is not desired to limit the invention to the exact construction, operation and embodiment shown and described, and accordingly all suitable modifications and equivalents may be resorted to, falling within the scope of the invention.

What is claimed:

1. A device for attachment to pants to prevent holes in shirts, comprising:

a front piece of fabric and a back piece of fabric, said front piece of fabric and said back piece of fabric having identical size and configuration, said front piece of fabric and said back piece of fabric each having a top edge, a bottom edge, and right and left side edges, said front piece of fabric positioned in front of said back piece of fabric so that their bottom edges and right and left side edges are aligned;

said front piece of fabric attached to the back piece of fabric along said bottom edges and right and left side edges, wherein the attachment along said right and left side edges extends only partially up the side edges, thereby forming a flap of fabric in said front piece of fabric and thereby dividing the device for attachment to pants into a top portion and bottom portion;

a buttonhole situated in said flap of said front piece of fabric, said buttonhole positioned below said top edge and between said left and right side edges of said front piece of fabric; and coordinating male and female snaps members located on said back piece of fabric and said flap on said front piece of fabric;

whereby a user who is wearing pants having a waistband and a button tucks the bottom portion of the device for attachment to pants into the waistband of the pants, folds the flap down, attaches the button of the pants to the buttonhole, folds the top portion of the back piece of fabric down over the flap and snaps together the coordinating snap members.

2. The device for attachment to pants of claim 1 wherein the said front and back pieces of fabric each comprise two pieces of fabric attached together.

3. A device for attachment to pants to prevent holes in shirts, comprising:

a front piece of fabric and a back piece of fabric, said front piece of fabric and said back piece of fabric each having a top edge, a bottom edge, and right and left side edges, said front piece of fabric positioned in front of said back piece of fabric so that their bottom edges and right and left side edges are aligned;

said front piece of fabric attached to the back piece of fabric along said bottom edges and right and left side edges, wherein the attachment along said right and left side edges extends only partially up the side edges, thereby forming a flap of fabric in said front piece of fabric and thereby dividing the device for attachment to pants into a top portion and bottom portion;

a buttonhole situated in said flap of said front piece of fabric, said buttonhole positioned below said top edge and between said left and right side edges of said front piece of fabric; and coordinating attachment members located on said back piece of fabric and said flap or said front piece;

whereby a user who is wearing pants having a waistband and a button tucks the bottom portion of the device for attachment to pants into the waistband of the pants, folds the flap down, attaches the button of the pants to the buttonhole, and folds the top portion of the back piece of fabric down over the flap and attaches together the coordinating attachment member.

4. A device for attachment to pants to prevent holes in shirts, comprising:

a front piece of fabric attached to the back piece of fabric, said front piece of fabric and said back piece of fabric each having a top edge, a bottom edge, and a right and left side edges, said front piece of fabric positioned in front of said back piece of fabric so that their bottom edges and right and left edges are aligned;

said front piece of fabric attached to the back piece of fabric along said bottom edges and right and left side edges, wherein the attachment along said right and left side edges extend only partially up the side edges thereby forming a flap of fabric in said front piece of fabric and thereby dividing the device for attachment to pants into a top portion and a bottom portion; and a buttonhole situated in said flap of said front piece of fabric; said buttonhole positioned below said top edge and between said left and right side edges of said front piece of fabric;

whereby a user is wearing said pants having a waistband and a button tucks the bottom portion of the device for attachment to pants into the waist band of the pants, folds the flap down, attaches the button of the pants to the buttonhole, and folds the top portion of the back piece of fabric down over the flap.

* * * * *